United States Patent [19]

Catozzo

[11] 4,002,522

[45] Jan. 11, 1977

[54] FILM SPLICING DEVICE

[76] Inventor: Leo Catozzo, Bivio per Tolfa, Km. 0,700, 00050 S. Severa, Italy

[22] Filed: July 14, 1975

[21] Appl. No.: 595,725

[30] Foreign Application Priority Data

Aug. 2, 1974 Italy ..... 52414/74

[52] U.S. Cl. ..... 156/506; 156/157

[51] Int. Cl.[2] ..... B31F 5/00; G03D 15/04

[58] Field of Search ..... 156/157, 159, 304, 502, 156/505–507, 545

[56] References Cited

UNITED STATES PATENTS

| | | | |
|---|---|---|---|
| 3,428,511 | 2/1969 | Catozzo | 156/505 |
| 3,450,589 | 6/1969 | Jorgensen | 156/505 |
| 3,717,535 | 2/1973 | Jorgensen | 156/506 X |

*Primary Examiner*—William A. Powell
*Attorney, Agent, or Firm*—Browdy and Neimark

[57] ABSTRACT

A splicing device for splicing together strips of material with an adhesive tape wherein the adhesive tape is stretched over the splice area between a front bridge and a rear bridge, at least one bridge being oscillatable between a position retracted from the dieplate where the material is positioned to a position closer to the dieplate, and the bridge may also be rectilinearly reciprocable between an uppermost and a lowermost position with respect to the dieplate.

8 Claims, 5 Drawing Figures

FILM SPLICING DEVICE

The invention refers to film splicers of the kind which uses adhesive tape to splice together strips of cinematographic film or other material.

BACKGROUND OF THE INVENTION

The splicers of this type generally comprise a lower dieplate, on which the strips to be joined together are placed end to end, a tape roll housing placed on one side of the dieplate at a generally right angle with it and from which a length of adhesive tape can be pulled across the joint area of the strip and pressed upon it to fasten said strips together in an end to end relatinship. Generally such splicers are provided with blades to cut the tape flush with the edges of the strips once the adhesive tape has been applied and, if the splicers are intended for joining together perforated strips, they are also provided with a punching head to punch perforations into the applied tape, in register with the perforations of the underlying film strips.

The improved types of splicers carry two additional members, one at each side of the lower dieplate, whose tops project slightly over the plane of said dieplate. They run parallel to the dieplate edges, correspondingly to the joint area of the film. In such improved splicers, the adhesive tape is not applied directly on the strips, but stretched between these two members (which shall be termed "bridges" in the following) over the joint area but out of contact with it. Only after this operation has been performed, the adhesive tape is pressed against the joint area and simultaneously cut flush with the dieplate edges by an upper dieplate provided with blades to cut the adhesive tape and, where perforated strips are to be spliced, provided with punches to punch the necessary perforations through the tape.

The main advantages reaped by the provision of these two bridges are firstly the possibility of precisely correcting the position of the strips relatively to each other and to the tape prior to the application of the latter upon the splice area, and secondly that the tape, once applied will lie perfectly smooth and wrinkle-free on the splice.

After the tape has been cut, a piece or flap of it will remain projecting from the top of each bridge towards the dieplate, the length of each flap corresponding to the width of the gap intervening between the bridge top and the dieplate edge facing it. The flap adhering to that bridge which is interposed between the dieplate and the tape roll (to be termed "front bridge" in the following) remains attached to the tape drawn from the taperoll. The flap on the other bridge is discarded.

The gap between the front bridge and the dieplate edge must be sufficiently wide to permit an operator to insert his finger tip into it, in order to grip said flap, detach it from the bridge and pull it across the lower dieplate to stick it to the bridge located at the opposite side of the dieplate (which bridge shall be termed "rear bridge" in the following), preparatory for a successive splice.

On this flap there is clearly visible, in addition to the marks of the operators fingers, also the linear mark left upon its lower surface by the front bridge. Consequently, this flap cannot be used for a new splice and must be discarded. Therefore, the longer the flap, the more tape is wasted. Furthermore, the flap projects horizontally from the bridge or even bends down from it into the gap, thereby rendering the operation of gripping it extremely difficult. These difficulties are enhanced when such splicers are handled in a darkroom.

Another drawback of the known splicers arises from the tendency of the tape rolls to assume, with time, a cylindro-conical shape, with the external windings of the tape roll shifting axially outward. Such cylindro-conical taperolls become unusable for the splicer, as they can no more be kept aligned with the joint area.

SUMMARY OF THE INVENTION

It is the object of the invention to eliminate these disadvantages of the stationary bridges of known splicers. The first disadvantage is obviated by rendering oscillatable at least one bridge, preferably the front one, with the result that the gap between it and the dieplate edge becomes variable in such a way,that the bridge top remains close to the dieplate edge when the tape is stretched across both bridges and snaps back, away from said edge, after the tape is cut, as by the blades of an upper dieplate. The resulting flap will be very short and the wastage of tape will be reduced, while the very shortness of the flap will prevent it from bending downward.

The axial displacements of the inner taperoll windings are eliminated by interposing, between each side of the taperoll and the adjacent wall of the taperoll housing, lateral disks, which fill out the intervening space.

For a purely illustrative and in no way limitative purpose, an embodiment of the invention will now be described with reference to the attached drawings, wherein:

DESCRIPTION OF PREFERRED EMBODIMENTS

Figure 2:
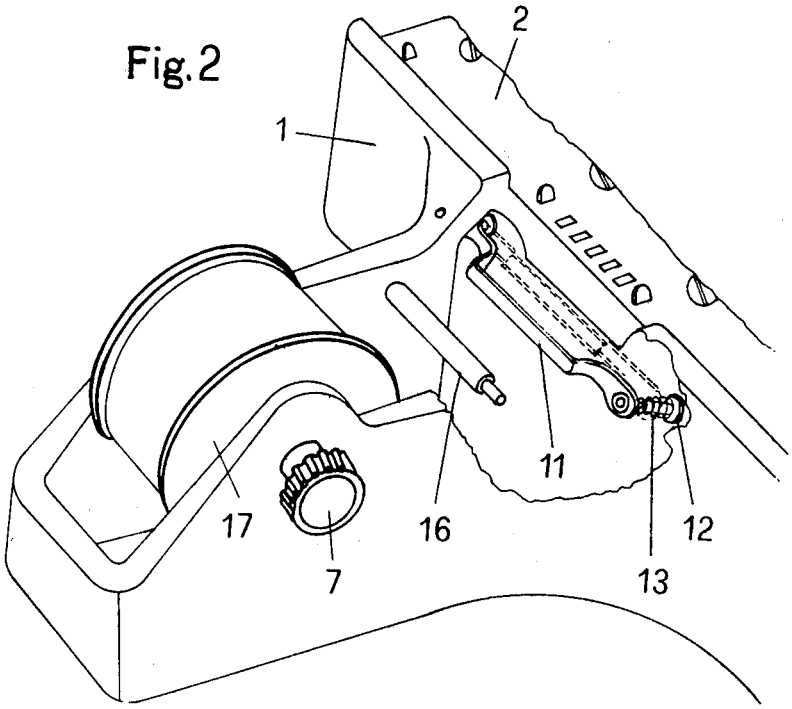
FIG. 2 shows a partly broken away enlarged scale view of the connection of the movable bridge to the known film splicer.
Figure 1:
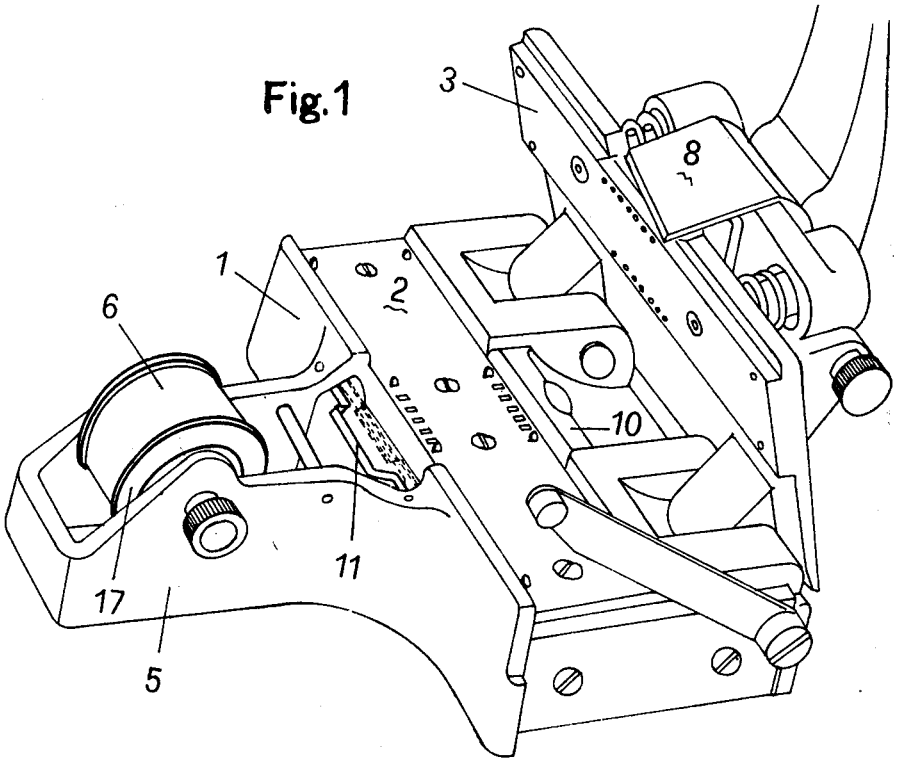
FIG. 1 is a perspective view of a known type of film splicer, wherein a stationary bridge has been replaced with an oscillatable one.

With reference to the figures, at 1 is indicated the base of the splicer, at 2 the lower die plate, upon which the strips to be spliced are positioned end to end, at 3 the upper dieplate, at 4 the edges of the lower dieplate, at 5 the taperoll housing, in which a taperoll 6 is rotatable around a pin 7 passed through the housing walls.

The width of the dieplates 2 and 3 equals that of the film strips and when the upper dieplate 3 is depressed upon the lower one, the blades 8 trim the tape 9 stretched across the rear bridge 10 and the front bridge 11 flush with the film edges, while the upper dieplate 3 itself presses the trimmed tape upon the film ends. Components 1 through 8 are of a known type and are here mentioned merely for a better understanding of the invention, and the same applies to bridge 10, which in this embodiment is chosen of the conventional stationary type.

Figure 3:
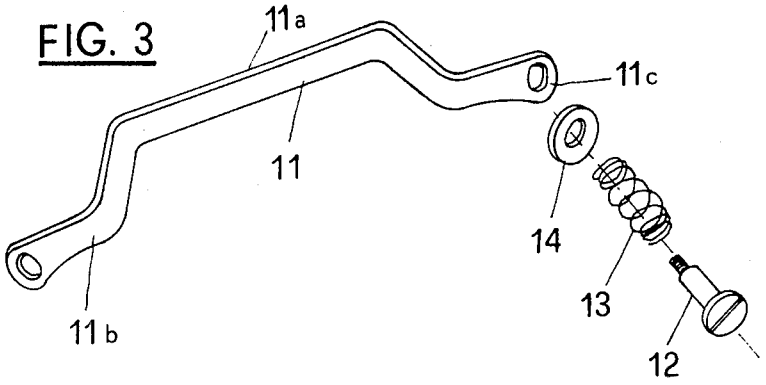
FIG. 3 is an exploded view, on a larger scale, of the oscillatable bridge and its fastening means.
Figure 4:
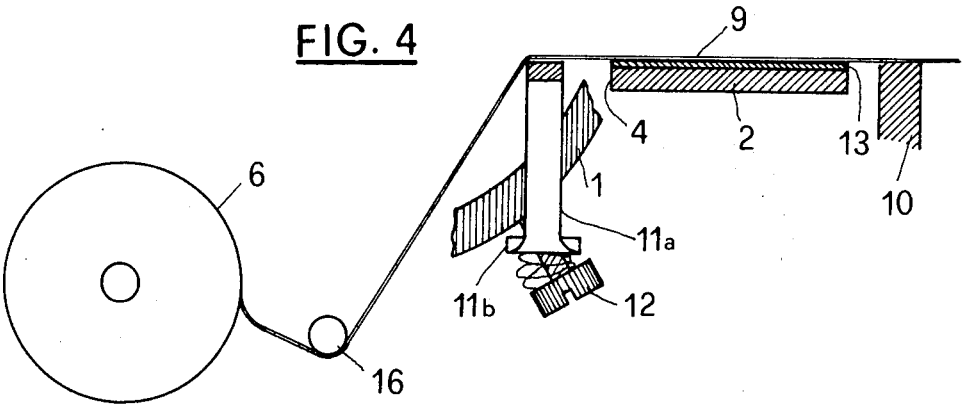
FIGS. 4 and 5 are a schematic views showing the operation of an oscillatable bridge according to the invention.
Figure 5:
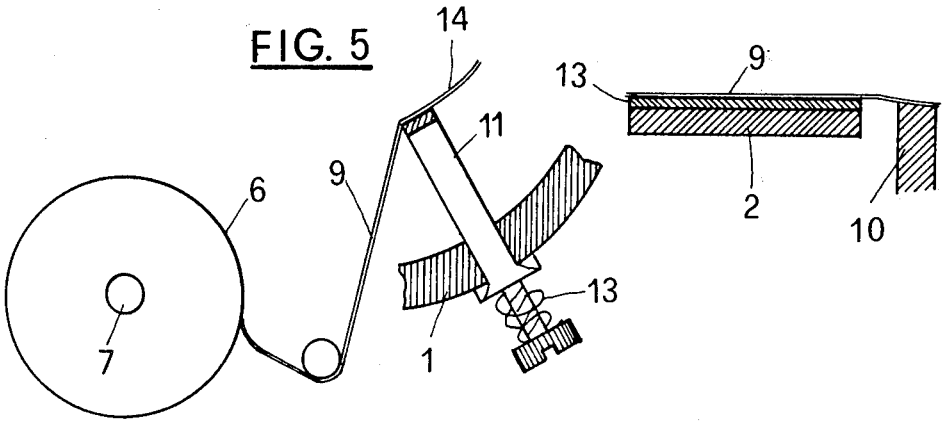

As better shown in FIG. 3, the oscillatable bridge 11 consists of a thin laminar element comprising a central, inverted U-shaped portion 11*a*, from whose arms extend two small flanges 11*b*, terminating in slightly enlarged ends, each end being fitted with a through bore 11*c*. The bridge is secured to the splicer base by bolts 12, each bolt passing through the corresponding hole ll*c*. A helical spring 13 and a washer 14 are interposed between the flanges 11*b* and the bolt heads, and the holes 11*c* of the bridge as well as that of the washer are of a larger diameter than the diameter of the unthreaded portion of the bolt shank. Consequently, the bridge is capable of performing, relatively to the bolt and consequently to the base, into which the bolt is screwed, two movements: a rectilinear stroke along the unthreaded bolt shank and a rotation relatively to the latter, as better shown in FIGS. 4 and 5, the spring constantly biasing the bridge towards its uppermost and retracted position shown in FIG. 5.

In operation, after two strips of cinematographic film or other material have been positioned end to end on the dieplate 2, an adequate length of tape 9 is drawn from the taperoll 6 over the oscillatable bridge 11 towards the stationary bridge 10. During this movement, the tape will also adhere to the oscillatable bridge 11 and entrain it, imparting to it thereby a rotatary motion towards the dieplate and simultaneously a downward stroke along the bolt shank, till it assumes the position shown in FIG. 4. Immediately after the tape has been cut by the blades 8, the oscillatable bridge will revert to the retracted position of FIG. 5, leaving thereby ample finger space between it and the dieplate edge, with an only very short flap 14 sticking to it. This flap is directed upwards and therefore it can be very easily gripped to be detached from the bridge and pulled towards the stationary bridge 10 for a successive splice.

It has been found that this operation of fastening the tape over the two bridges in the above described manner can be rendered more efficient and easier when the tape 9 approaches the oscillatable bridge 11 from a very steep angle. This can be obtained either by positioning the tape roll pin 7 very low with respect to the bridge tops or by interposing a roller 16 between the tape roll 6 and the bridge 11 in the taperoll housing, and passing the tape under said roller 16 before applying it to the bridges.

In order to prevent the taperoll from assuming a cylindro-conical conformation and to keep it constantly aligned with the splice area, a disc 17 is interposed in the space between each side of the taperoll and the adjacent lateral wall of the tape housing, the thickness of each disc being such as to practically fill out said space. A set of discs of various thicknesses and diameters may be provided, in order to render a splicer adaptable to the use of different tape formats.

It is clear that the above illustrated shape of the movable bridge and the manner of its connection with the base, although particularly simple and advantageous, may be easily varied, for instance by rendering the bridge rotatable around a shaft, which is in its turn slidable within slots cut into the base, springs being provided to bias the bridge towards its retracted position and the shaft towards an upper position. For the invention to be operable it is sufficient that the bridge performs a purely rotatory motion around an axis parallel to the dieplate. The linear motion, at an angle to the dieplate, as the stroke along the shank of bolts 12 is advantageous, but not indispensable.

It is also obvious to render both bridges oscillatable or, where the particular construction of the splicer warrants it, to render only the rear bridge movable and the front bridge stationary. These and other variants and changes are all encompassed within the scope of the invention.

What is claimed is:

1. A device for splicing together, strips of material with adhesive tape, the device comprising:

a lower dieplate for supporting the strips of material to be spliced together on a flat surface thereof; and a front bridge and a rear bridge located respectively adjacent lateral edges of said flat surface with respective tops projecting slightly above said flat surface and between which adhesive tape is to be stretched above the strips in vicinity of that area at which they are to be jointed, at least one of said bridges being an oscillatable bridge mounted for movement between its position adjacent said flat surface and a retracted position away from said lower dieplate which provides a gap between said lower dieplate and said oscillatable bridge; whereby an operator may readily insert his finger into the gap in order to grip an end of an adhesive tape carried by the oscillatable bridge subsequent to cutting of the tape.

2. A device according to claim 1, including mounting means coupled to said oscillatable bridge for allowing rectilinearly reciprocable movement of said oscillatable bridge between an uppermost and a lowermost position with respect to said lower dieplate.

3. A device according to claim 1, including spring means biasing said oscillatable bridge towards said retracted position.

4. A device according to claim 1, including spring means biasing said oscillatable bridge towards it uppermost position.

5. A device according to claim 2, including a base, and wherein said oscillatable bridge has the shape of an inverted U with flanges extending from its arms, said oscillatable bridge being connected to said base by bolts passing through holes provided in said flanges, said holes being of a diameter larger than the diameter of the shanks of said bolts, in order to permit said bridge to oscillate relatively to said shanks and to reciprocate along them.

6. A device according to claim 5, further comprising springs interposed between said flanges and the heads of said bolts to bias said oscillatable bridge towards it uppermost and retracted position.

7. A device according to claim 1, further comprising a housing for the roll of the adhesive tape used for splicing and a plurality of lateral discs, practically filling out the space between each side of a given tape roll and the adjacent walls of said housing.

8. A device according to claim 1, including means for mounting said oscillatable bridge for arcuate movement about an axis parallel to and lower than said flat surface.

* * * * *